US009303340B2

(12) United States Patent
Rones et al.

(10) Patent No.: US 9,303,340 B2
(45) Date of Patent: Apr. 5, 2016

(54) PROCESS FOR CREATING A VARIABLE DENSITY, HIGH LOFT, NON-WOVEN WEB STRUCTURE

(71) Applicant: Americo Manufacturing Co., Inc., Acworth, GA (US)

(72) Inventors: Richard L. Rones, Marietta, GA (US); Sandy J. Pangle, Cohutta, GA (US)

(73) Assignee: Americo Manufacturing Co., Inc., Acworth, GA (US)

( * ) Notice: Subject to any disclaimer, the term of this patent is extended or adjusted under 35 U.S.C. 154(b) by 353 days.

(21) Appl. No.: 13/936,833

(22) Filed: Jul. 8, 2013

(65) Prior Publication Data

US 2014/0007393 A1 Jan. 9, 2014

Related U.S. Application Data

(60) Provisional application No. 61/669,436, filed on Jul. 9, 2012.

(51) Int. Cl.
*D04H 1/732* (2012.01)
*D06C 15/00* (2006.01)

(52) U.S. Cl.
CPC ..... *D04H 1/732* (2013.01); *D06C 15/00* (2013.01); *Y10T 428/24802* (2015.01)

(58) Field of Classification Search
CPC ..... D04H 1/732; D04H 1/736
USPC ..... 19/301, 304, 308
See application file for complete search history.

(56) References Cited

U.S. PATENT DOCUMENTS

| | | | | | |
|---|---|---|---|---|---|
| 2,912,723 | A * | 11/1959 | Roberts | B27N 3/14 | 19/301 |
| 3,681,183 | A | 8/1972 | Kalwaites | | |
| 3,966,858 | A * | 6/1976 | Troy | D04H 1/72 | 156/62.2 |
| 4,351,793 | A * | 9/1982 | Day | D04H 1/736 | 19/304 |
| 5,076,774 | A * | 12/1991 | Farrington | A61F 13/15634 | 156/62.2 |
| 5,167,579 | A | 12/1992 | Rotter | | |
| 5,575,874 | A * | 11/1996 | Griesbach, III | A61F 13/15658 | 156/167 |
| 5,893,197 | A * | 4/1999 | Vartiainen | A61F 13/15626 | 19/296 |
| 2002/0169434 | A1* | 11/2002 | Baker | A61F 13/5323 | 604/385.101 |
| 2011/0189940 | A1 | 8/2011 | Kerwood-Winslow et al. | | |

FOREIGN PATENT DOCUMENTS

| | | | |
|---|---|---|---|
| CA | 2611314 | A1 | 1/2007 |
| WO | WO 01/98574 | A2 | 12/2001 |

* cited by examiner

*Primary Examiner* — Shaun R Hurley
(74) *Attorney, Agent, or Firm* — Baker Hostetler LLP

(57) ABSTRACT

A process is disclosed for creating air laid, high loft, non-woven, variable density web structures. The fiber manipulation and distribution necessary to produce a variable weight and density web is accomplished by creating variable, negative pressure regions across the surface of a condenser or other vacuum screen, which causes fibers to migrate toward areas of lower pressure. Also disclosed are embodiments of condenser and vacuum screens for producing such variable density web structures.

10 Claims, 9 Drawing Sheets

PROCESS FOR CREATING A VARIABLE DENSITY, HIGH LOFT, NON-WOVEN WEB STRUCTURE

CROSS REFERENCE TO RELATED APPLICATIONS

The present application is a nonprovisional of, and hereby claims priority to and the full benefit of, U.S. Patent Application No. 61/669,436, filed Jul. 9, 2012, entitled "Process for Creating a Variable Density, High Loft, Non-Woven Web Structure," the entire contents of which are hereby incorporated herein by reference.

TECHNICAL FIELD

The present disclosure is directed, generally, to processes for creating high loft, non-woven web structures; and, more particularly, to processes for creating variable density, high loft, non-woven web structures.

BACKGROUND

High loft, non-woven, uniform density web structures comprise a variety of everyday products. Examples may be found in products such as cleaning pads, scrubber and polishing pads, furniture batting, furnace filters, sand and dirt barriers, construction material barriers, and the like. A particular and exemplary application for such high loft, non-woven, uniform density web structures may be seen with regard to ridge vents for a gable-style roof.

It is well-known that a vent along the ridge of a gable-style roof is effective in drawing hot, stale air out of the interior space covered by the roof, usually an attic. Convection flow draws the highest temperature air to the ridge crest and out the vent. Wind across the vent line is directed up and over the vent by the sloping sides of the roof, creating a lower pressure at the vent which draws air out of the attic even when there is little convection current. When combined with soffit vents under the eaves to draw fresh air, a ridge vent usually provides more effective attic ventilation than turbine vents or large vent cans. The effectiveness of the vent depends, however, upon the degree to which convection outflow and wind across the vent line is uninhibited by the vent structure. Most effective would be a completely uncovered vent, but the need to keep out rain water, dirt, and pests requires some sort of covering structure. The design considerations for a covering structure are, therefore, to maximize convection outflow and drawn air inflow; to establish an effective barrier against water, dirt, and insect entry; and to maintain aesthetic appearance and long term durability, while providing low cost and ease of installation.

In accordance with such design considerations, a common practice for ventilating attic spaces under gable-style roofs is through use of a high loft, non-woven, uniform density fabric mat. An example of representative prior art fabric meeting this description may be seen with reference to U.S. Pat. No. 5,167,579 issued Dec. 1, 1992 to Rotter. Such fabric is made of randomly aligned fibers which are bonded with latex, acrylic, or phenolic resins. The fabric is permeable, and is most typically approximately 10½" wide and approximately 18 mm thick. Installed, the fabric runs along most, if not all, of the uppermost ridge of the roof.

As may be seen with reference to FIG. 1 (prior art), the fabric is installed on top of an approximate 1½" to 2" open slot in the roof. In new construction, the slot is formed by cutting the upper row sheeting panels of the roof a predetermined amount short of the ridge crest formed by the rafters in a roof truss. In existing structures, the slot can be formed by cutting away the same size strip from the sheeting at the ridge on both sides, taking care not to damage the rafters or ridge pole, and terminating a predetermined distance from the front and back sides of the roof.

Roof shingles are laid in overlapping rows in the conventional manner up to the slot. As is well-known in the art, the fabric may easily be laid over the slot by unwinding one end of the material from a roll and centering it over the slot at one end, then unrolling it in a continuous strip to the other end, where it is cut from the roll. If it is necessary or desirable to join strips of the fabric, such joinder can be made by merely coating the abutting ends with synthetic rubber sealant used for bonding asphalt shingles and sealing around flashing, or any other suitable caulk or adhesive, and abutting the strips end-to-end, as is known in the art.

A ridge cap, formed from cap shingles, is affixed on top of the fabric in order to prevent rain water from entering the attic space through the aforedescribed permeable ridge vent fabric and open slot. Starting from one end and working to the other, each cap shingle is laid over the fabric. Each cap shingle overlaps the edge of the preceding cap shingle, and is secured by driving roofing nails through the cap shingle, fabric, and roof shingle into the underlying sheeting and rafters. The fabric is sufficiently resistant to compression that the installer can easily feel when the shingle is pressed firmly against the fabric, and can sink the nail only until the nail head is against the shingle, leaving the cap raised about ⅝" above the underlying roof shingles.

Thus, as described, the fabric runs the length of the slot, overlapping the slot evenly on each side, and is of such low profile that it does not attract attention when covered by cap shingles or tiles of the same color and texture as used on the rest of the roof.

With the ridge cap covering only the top surface of the non-woven, high loft fabric, the linear edges, or "sides," of the high loft fabric are exposed. This allows for hot air from inside the interior space to pass through the open slot that runs along the roof ridge line, through the bottom side of the permeable, high loft, non-woven fabric, and out through the exposed sides of the fabric.

Since the high loft, non-woven fabric and ridge cap are wider than the open slot along the ridge line, and because it is installed on a gable-style roof with the exposed ends of the fabric below the peak elevation of the middle of the fabric, the fabric provides adequate air ventilation, and also forms an effective barrier against wind driven rain, snow, insects, and debris entering the attic space.

Disadvantageously, however, the middle portion of the high loft, non-woven fabric that directly covers the open slot is not effective in preventing water and certain debris from infiltrating inside the attic space. Accordingly, the middle portion of the fabric serves primarily as a gap space to facilitate airflow. Since the area between the exposed outside end of the high loft, non-woven fabric and the inside open slot is the most critical in preventing outdoor elements, such as rain, snow, insects, and debris, from entering the interior space, it would be desirable to produce an improved, high loft, non-woven fabric, comprising a variable density web. Such an improved, high loft, non-woven, variable density web structure would provide for improved, desirable physical properties, such as higher rates of airflow and greater compression resistance, at a reduced overall total weight.

By forming a high loft, non-woven fabric with a higher concentration of fibers along the edges, and a lower concentration of fibers along the middle, a fabric can be produced at an overall lower basis weight, providing improved air ventilation properties, all while continuing to serve as an effective barrier to water, debris, and insect infiltration.

While an exemplary application for such an improved, high loft, non-woven, variable density web structure has been described above in association with ridge vents for gable-style roofs, it will be appreciated that numerous other and further applications are contemplated, including, but not limited to, cleaning pads, scrubber and polishing pads, furniture batting, furnace filters, sand and dirt barriers, construction material barriers, and the like.

Accordingly, it is to the provision of processes for creating such improved, high loft, non-woven, variable density web structures that the present disclosure is directed.

SUMMARY

The present disclosure is directed to a process for creating air laid, high loft, non-woven web structures comprising varying weight and/or density distribution across the web structure.

In some embodiments, the process for creating air laid, high loft, non-woven web structures comprising varying weight and/or density distribution across the web structure begins with opening or carding bales of packed synthetic or natural staple fiber. The purpose of opening the fiber is to create as much space as possible between the individual strands of fiber within the confines of the process. This is accomplished by feeding fiber from raw or bale form into opening and/or processing equipment that contain multiple rotating, cylindrical, wired rolls, and/or a series of pinned aprons and conveyors, that pull tufts of fibers apart and into individual strands.

Once opened and/or carded, the fibers are transported via air stream, conveyor, or other transport means to feeder and web forming machinery. The purpose of the feeder is to accumulate a sufficient quantity of opened fiber to allow the continuous creation and transportation of a uniform density feed mat directly into the web forming machine.

As the feed mat enters the web forming machine, a rotating, cylindrical, wired roll pulls individual strands of fiber from the feed mat, and the fibers enter into a controlled, high velocity air stream. The fibers are carried through the air stream and are deposited on a rotating, cylindrical metal condenser screen with perforated holes set in a predetermined pattern. The high velocity air passes through the perforated holes in the rotating condenser screen while the fibers hit the screen and form a continuous, non-woven web.

One or more predetermined pattern of openings in the rotating condenser screen allows for the creation of a non-woven web with varying density. This is accomplished by directing air and fiber to surface areas of the condenser screen with a greater concentration and/or larger diameter openings, and away from surface areas containing lesser concentration and/or a solid surface with no openings.

Accordingly, the fiber manipulation and re-distribution necessary to produce a variable weight and density web is accomplished by creating variable negative pressure points on the cylindrical condenser screen. This causes the fibers to migrate toward areas of lower pressure. There are several methods available for changing the low pressure areas in this process. Among such methods are mechanically blocking off holes, omitting holes, restricting hole diameters, and/or changing hole density in order to achieve a desired pattern of variable weight and density web. Such changes affect the airflow patterns around the condenser screen and yield the desired pattern.

The same innovation can be applied to other types of machinery for producing such a web. Such machinery includes, without limitation, any static vacuum screen, rotating vacuum screen, or vacuum conveyor on which fibers are air laid.

These and other features and advantages of the various embodiments of a process for creating air laid, high loft, non-woven web structures comprising a varying weight and density distribution across the web structure, as set forth within the present disclosure, will become more apparent to those of ordinary skill in the art after reading the following Detailed Description of Illustrative Embodiments and the Claims in light of the accompanying drawing Figures.

BRIEF DESCRIPTION OF THE DRAWINGS

Accordingly, the within disclosure will be best understood through consideration of, and with reference to, the following drawing Figures, viewed in conjunction with the Detailed Description of Illustrative Embodiments referring thereto, in which like reference numbers throughout the various Figures designate like structure, and in which.

Figure 1:
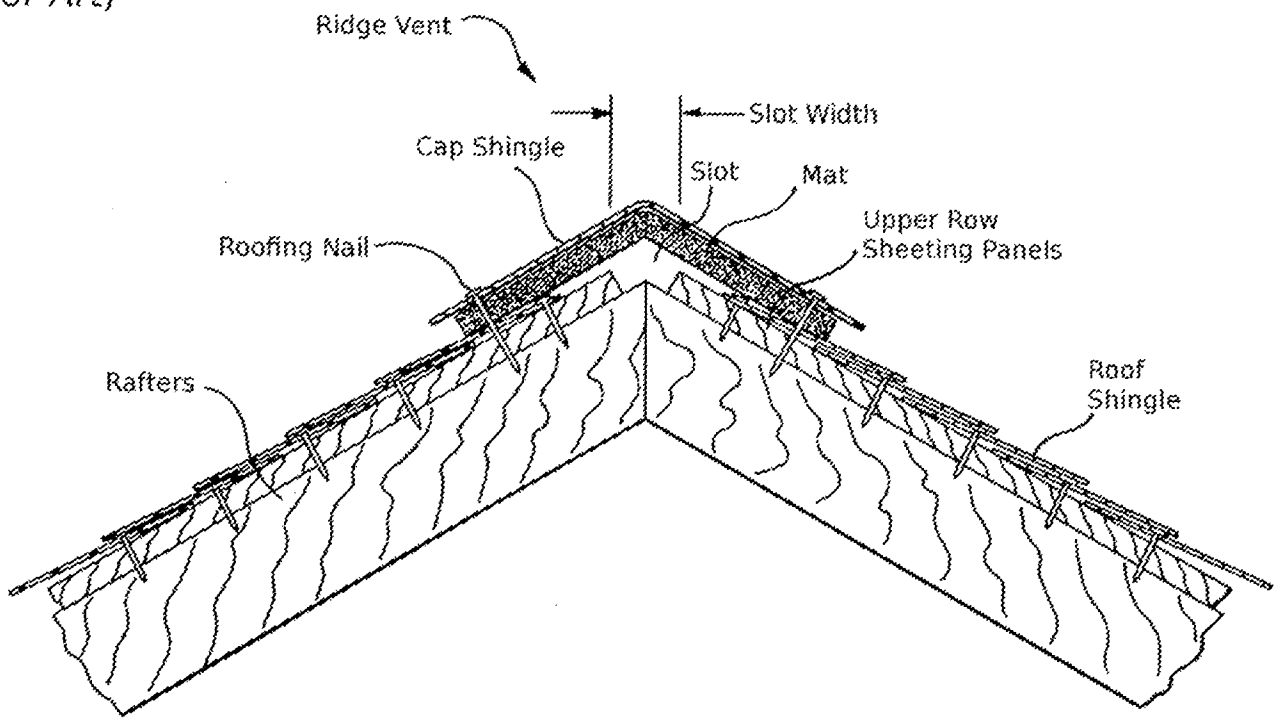
FIG. 1 (Prior Art)
FIG. 1 illustrates a sectional view taken at the ridge of a roof, showing an exemplary ridge vent using a high loft, non-woven, uniform density fabric mat according to the prior art.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing the several embodiments illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose. Additionally, in the Figures, like reference numerals shall be used to designate corresponding parts throughout the several Figures.

Figure 2:
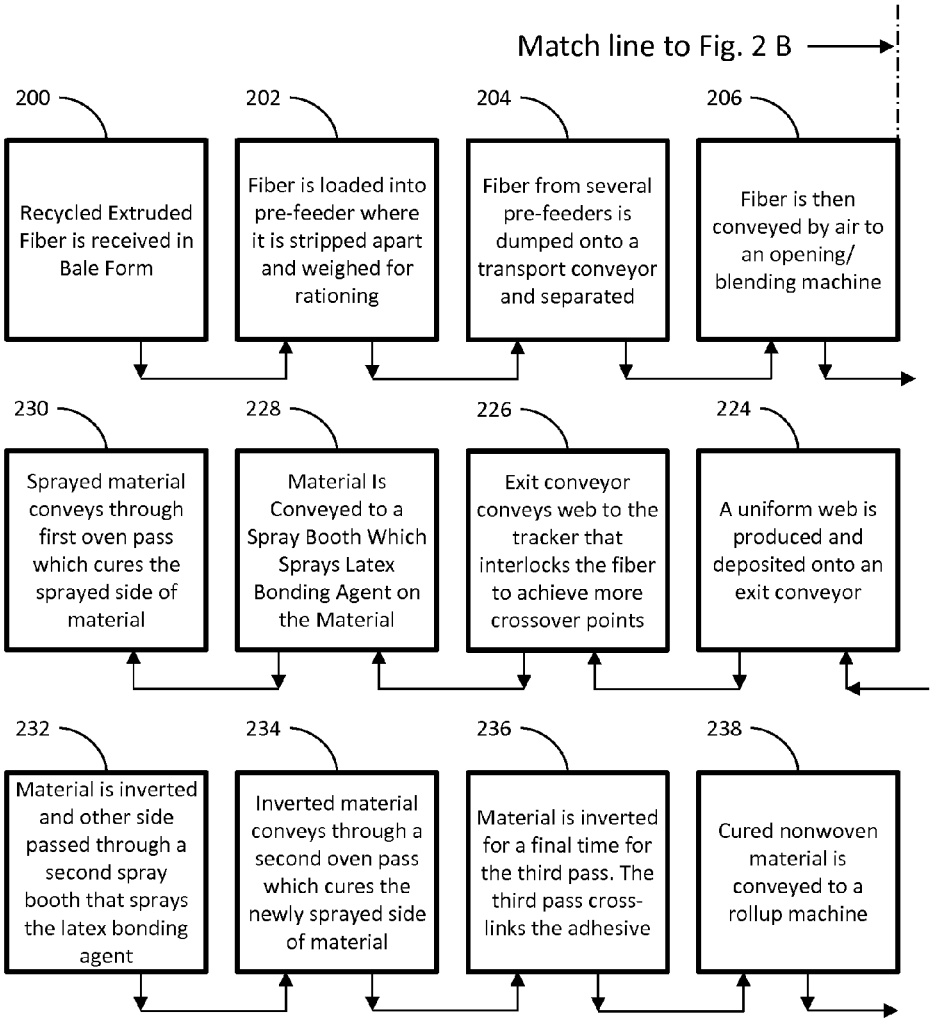
Fig. 2 A (Prior Art)
FIGS. 2A-2B depict a process flow according to the prior art for producing high loft, non-woven, uniform density web structures.
Figure 2:
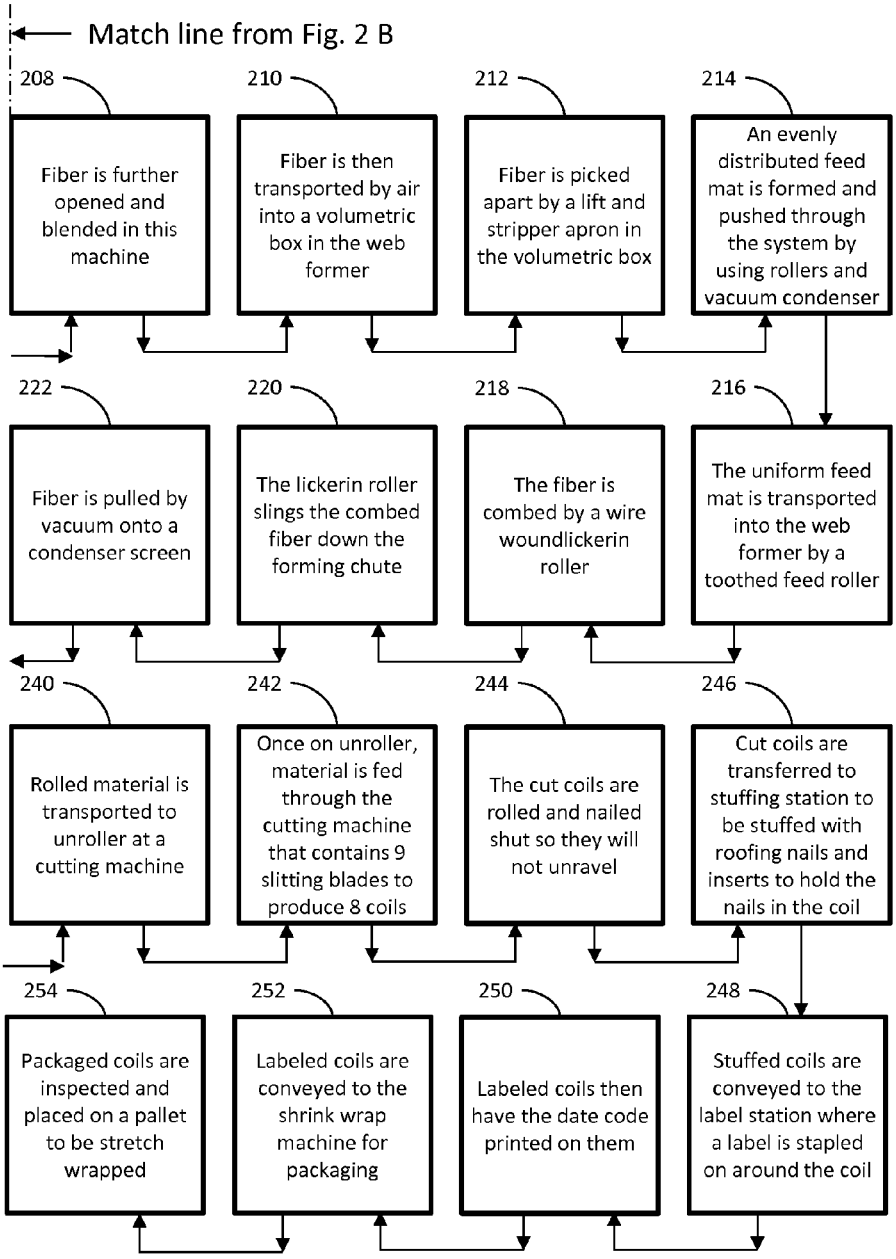
Fig. 2 B (Prior Art)

Illustrated in FIGS. 2A-2B is an exemplary process flow according to the prior art for producing high loft, non-woven, uniform density web structures. According to the prior art process flow, staple fiber is received in bale form, as depicted at step 200. The fiber typically comprises synthetic fibers, such as nylon or polyester. As such, the synthetic fiber may come from recycled or virgin stock.

The fiber is loaded into pre-feeders, where it is stripped apart to remove clumps and is weighed for rationing, as depicted at step 202. Fiber from several pre-feeders is fed onto a transport conveyor and separated, as depicted at step 204. Fiber is then conveyed by airflow or other transport means to an opening/blending machine, as depicted at step 206, where it is further opened and blended, as depicted at step 208. Fiber is then transported by airflow or other transport means into a volumetric box in the web former, as depicted at step 210. Fiber is picked apart by a lift and stripper apron in the volumetric box, as depicted at step 212. An evenly distributed feed mat is formed and pushed through the system by using rollers and a vacuum condenser, as depicted at step 214.

The uniform feed mat is next transported into the web former by a toothed feed roller, as depicted at step 216. The fiber is combed by a wire wound, lickerin roller, as depicted at step 218. The lickerin roller slings the combed fiber into and down a forming chute, as depicted at step 220. Fiber is pulled by vacuum onto a condenser screen, as depicted at step 222. A uniform web is produced and deposited onto an exit conveyor, as depicted at step 224. The exit conveyor conveys the web to a tacker unit that interlocks the fiber to achieve a greater number of fiber cross-over points for mechanical stability, as depicted at step 226. The material is conveyed to a spray booth wherein a first side of the material is sprayed with a bonding agent, as depicted at step 228. The bonding agent may comprise latex, acrylic, phenolic resins, or the like.

Sprayed material is conveyed through a first oven pass which cures the sprayed side of the material, as depicted at step 230. The material is inverted and is passed through a second spray booth, wherein the second side is sprayed with a bonding agent, as depicted at step 232. The inverted material is conveyed through a second oven pass which cures the second side of the material, as depicted at step 234. The material is inverted for a final time and is passed through an oven for a third time, as depicted at step 236, wherein the adhesive is crosslinked. The cured, non-woven material is conveyed to a roll-up machine, as depicted at step 238. Rolled material is transported to an unroller at an unwinder, slitter, rewinder-type cutting machine, as depicted at step 240. Once loaded onto the unwinder machine, the material is fed through the cutting machine that contains, for example, nine (9) slitting blades for producing eight (8) coils of material, as depicted at step 242. The cut material coils are rolled and nailed shut to prevent them from unraveling, as depicted at step 244.

For roof vent applications, cut coils are then transferred to a stuffing station to be stuffed with roofing nails and inserts to hold the nails in the coil, as depicted at step 246. Stuffed coils are then conveyed to a labeling station, where a label is stapled on or around the coil, as depicted at step 248. Labeled coils may then have a date and/or other code printed on them, as depicted at step 250. The coils are then conveyed to a shrink wrap machine for packaging, as depicted at step 252. Finally, packaged coils are inspected and placed on a pallet to be stretch wrapped, as depicted at step 254.

Figure 3A:
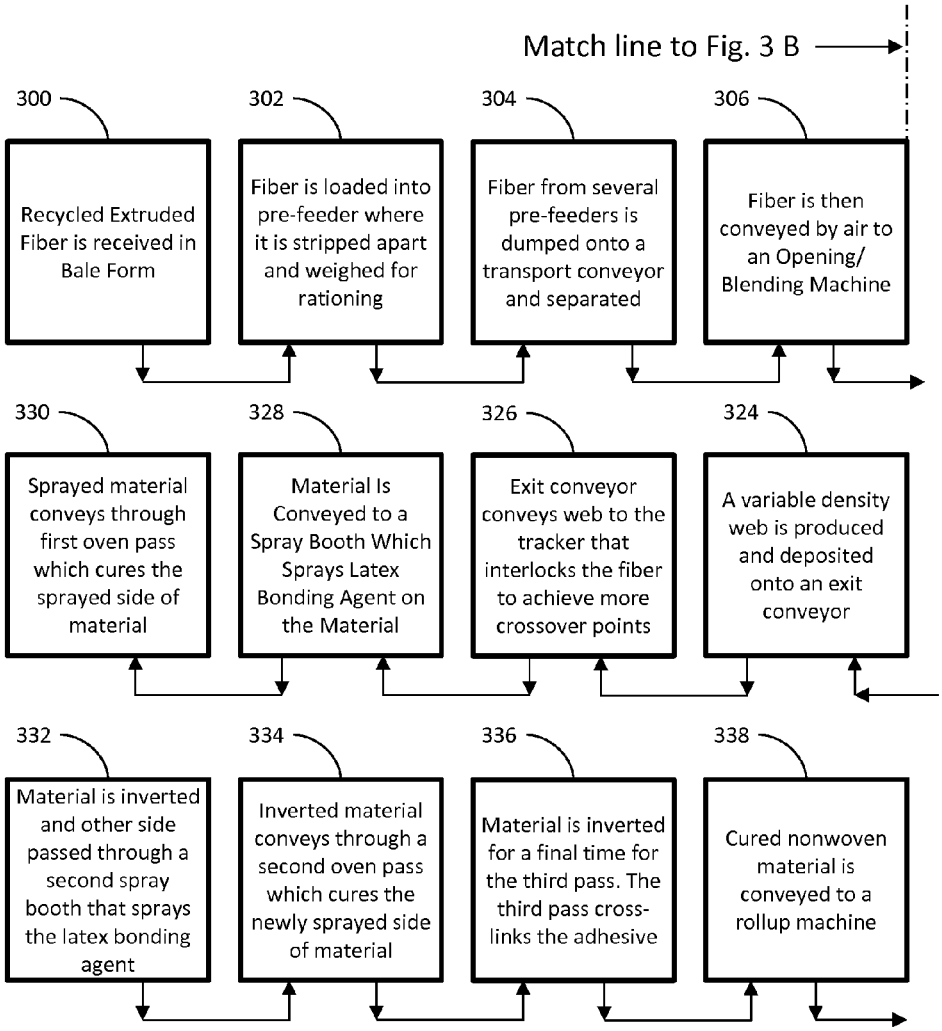
FIGS. 3A-3B depict a process flow according to the present disclosure for producing high loft, non-woven, variable density web structures.
Figure 3B:
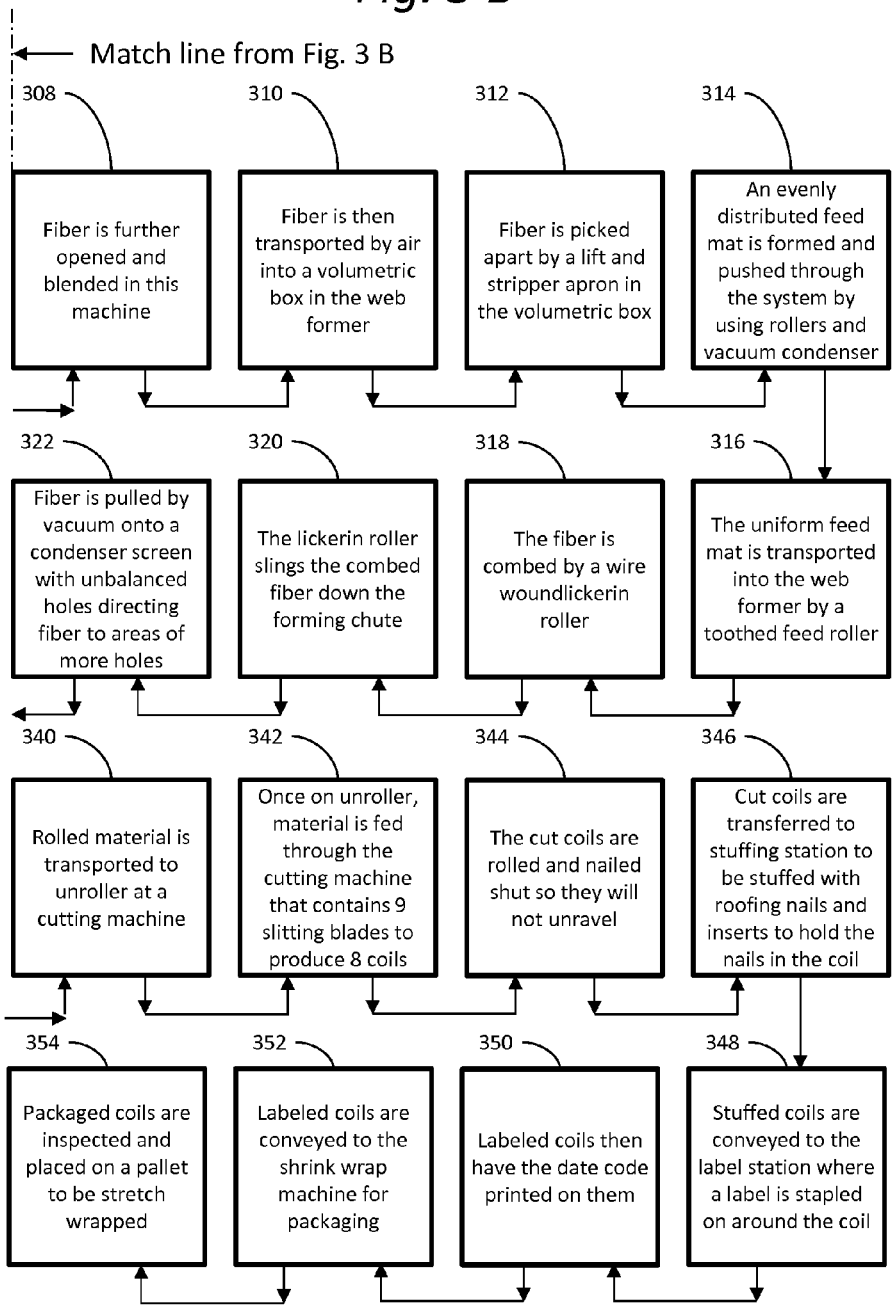

Illustrated in FIGS. 3A-3B is an exemplary process flow according to the present disclosure for producing high loft, non-woven, uniform density web structures. According to the process flow of the present disclosure, staple fiber is received in bale form, as depicted at step 300. The fiber typically comprises synthetic fibers, such as nylon or polyester. As such, the synthetic fiber may come from recycled or virgin stock.

The fiber is loaded into pre-feeders, where it is stripped apart to remove clumps and is weighed for rationing, as depicted at step 302. Fiber from several pre-feeders is fed onto a transport conveyor and separated, as depicted at step 304. Fiber is then conveyed by airflow or other transport means to an opening/blending machine, as depicted at step 306, where it is further opened and blended, as depicted at step 308. Fiber is then transported by airflow or other transport means into a volumetric box in the web former, as depicted at step 310. Fiber is picked apart by a lift and stripper apron in the volumetric box, as depicted at step 312. An evenly distributed feed mat is formed and pushed through the system by using rollers and a vacuum condenser, as depicted at step 314.

The uniform feed mat is next transported into the web former by a toothed feed roller, as depicted at step 316. The fiber is combed by a wire wound, lickerin roller, as depicted at step 318. The lickerin roller slings the combed fiber into and down a forming chute, as depicted at step 320. Significantly, as depicted at step 322, and differing materially from the prior art process depicted in FIGS. 2A-2B at step 222, fiber is pulled by vacuum onto a condenser screen comprising, in some embodiments, regions having blocked-off holes or no holes, or in other embodiments, regions having unbalanced or non-uniform hole patterns or hole distributions, or in other embodiments, regions having smaller holes, different or differing hole patterns or hole distributions, or the like, any of which serve to direct fiber to areas of the condenser screen having more holes and/or areas of the condenser screen having greater airflow. Accordingly, a variable density web is produced and deposited onto an exit conveyor, as depicted at step 324. The exit conveyor conveys the web to a tacker unit that interlocks the fiber to achieve a greater number of fiber cross-over points for mechanical stability, as depicted at step 326. The material is conveyed to a spray booth wherein a first side of the material is sprayed with a bonding agent, as depicted at step 328. The bonding agent may comprise latex, acrylic, phenolic resins, or the like.

Sprayed material is conveyed through a first oven pass which cures the sprayed side of the material, as depicted at step 330. The material is inverted and is passed through a second spray booth, wherein the second side is sprayed with a bonding agent, as depicted at step 332. The inverted material is conveyed through a second oven pass which cures the second side of the material, as depicted at step 334. The material is inverted for a final time and is passed through an oven for a third time, as depicted at step 336, wherein the adhesive is crosslinked. The cured, non-woven material is conveyed to a roll-up machine, as depicted at step 338. Rolled material is transported to an unroller at an unwinder, slitter, rewinder-type cutting machine, as depicted at step 340. Once loaded onto the unwinder machine, the material is fed through the cutting machine that contains, for example, nine (9) slitting blades for producing eight (8) coils of material, as depicted at step 342. The cut material coils are rolled and nailed shut to prevent them from unraveling, as depicted at step 344.

For roof vent applications, cut coils are then transferred to a stuffing station to be stuffed with roofing nails and inserts to hold the nails in the coil, as depicted at step 346. Stuffed coils are then conveyed to a labeling station, where a label is stapled on or around the coil, as depicted at step 348. Labeled coils may then have a date and/or other code printed on them, as depicted at step 350. The coils are then conveyed to a shrink wrap machine for packaging, as depicted at step 352. Finally, packaged coils are inspected and placed on a pallet to be stretch wrapped, as depicted at step 354.

Having now described exemplary process steps for producing high loft, non-woven, uniform density web structures of the prior art, along with, and in contrast to, exemplary process steps for producing high loft, non-woven, variable density web structures of the present disclosure, we turn to comparison and disclosure of embodiments of machine elements useful for creating such structures.

Figure 4:
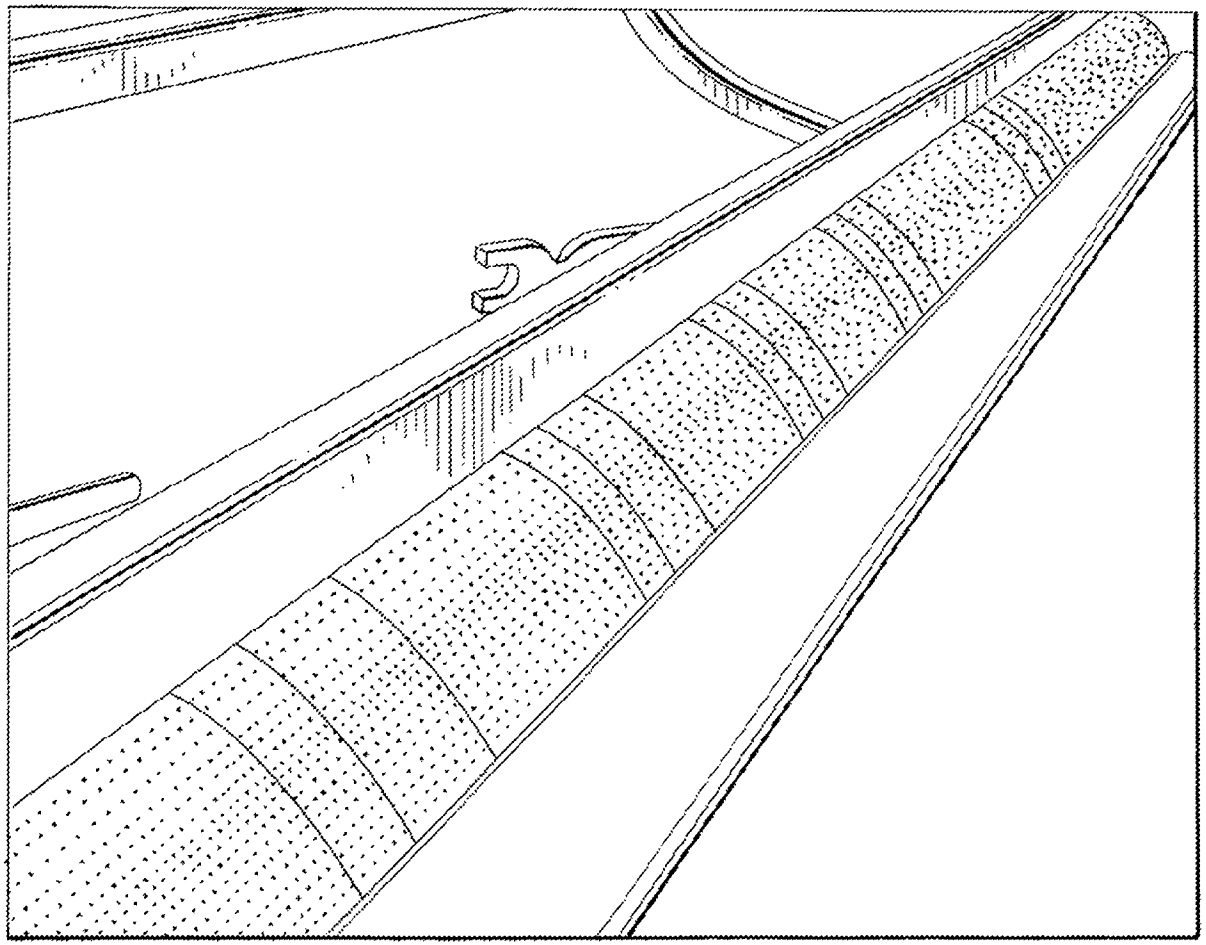
Fig. 4 (Prior Art)
FIG. 4 is a perspective view of process machinery, according to the prior art process depicted in FIG. 2 at steps 220-222, for producing high loft, non-woven, uniform density web structures.

Accordingly, depicted in FIG. 4 is a perspective view of exemplary prior art process machinery for producing high loft, non-woven, uniform density web structures, corresponding to the prior art process depicted in FIGS. 2A-2B at steps 220-222. Fiber is pulled by vacuum from the web forming chute and onto the condenser screen. A uniform number, pattern, and density of holes formed within the prior art condenser screen ensure that a uniform vacuum is established across the condenser screen during operation. In turn, a uniform vacuum across the condenser screen ensures that a uniform density, prior art web is produced.

Figure 5:
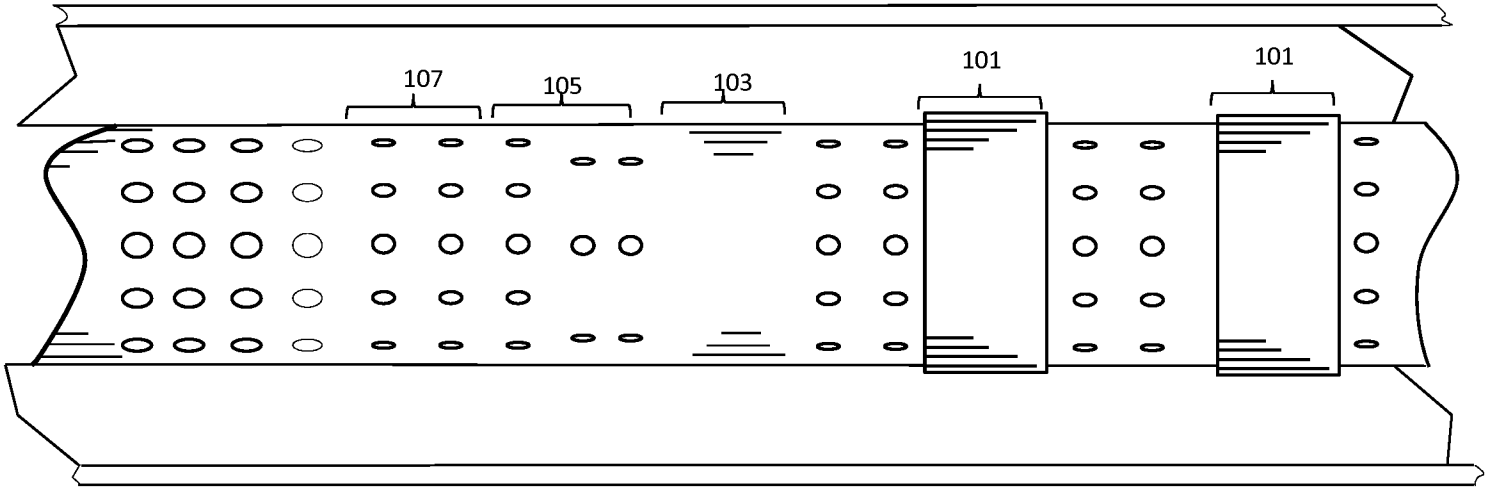
FIG. 5 is a perspective view of process machinery, according to the process of the present disclosure depicted in FIG. 3 at steps 320-322, for producing high loft, non-woven, variable density web structures.

By contrast, a condenser screen according to the present disclosure is modified as shown in FIG. 5 to comprise, in some embodiments, regions having blocked-off holes 101 or no holes 103, or in other embodiments, regions having unbalanced or non-uniform hole patterns or hole distributions 105, or in other embodiments, regions having smaller holes 107, or the like, any of which serve to direct fiber to areas of the condenser screen having more holes and/or areas of the condenser screen having greater airflow. Accordingly, and advantageously over the prior art, a condenser screen operating with a non-uniform vacuum across its surface will produce a high loft, non-woven, variable density web structure.

One exemplary embodiment of such a condenser screen for producing high loft, non-woven, variable density web structures may be seen with reference to FIG. 5. In FIG. 5 is shown a top view of an exemplary condenser screen and other process machine elements according to the present disclosure, for use corresponding to the process depicted in FIGS. 3A-3B at steps 320-322. As can be seen therein, regions of holes within the condenser screen are blocked (see region 101), or otherwise obstructed (see region 103), in parallel, banded regions about and across the surface of the condenser screen. The blocked regions are established to correspond to desired design specifications for the high loft, non-woven, variable density web structures to be produced. As described above, these blocked or obstructed regions of the condenser screen provide that, when in operation, a non-uniform vacuum is established across the surface of the condenser screen. Such non-uniform vacuum across the surface of the condenser screen will, in turn, produce a high loft, non-woven, variable density web structure corresponding to the blocked and open regions of the condenser screen.

It will be appreciated that, although the embodiment of FIG. 5 is depicted having blocked or obstructed regions of the condenser screen, in alternative embodiments, a condenser screen may be provided with such other configurations as have been described elsewhere in this disclosure, and also their functional equivalents, any of which serve during operation to direct fiber to areas of the condenser screen having greater airflow and/or greater negative pressure. Accordingly, all such condenser screen embodiments are contemplated as falling within the scope of the present disclosure.

Figure 6:
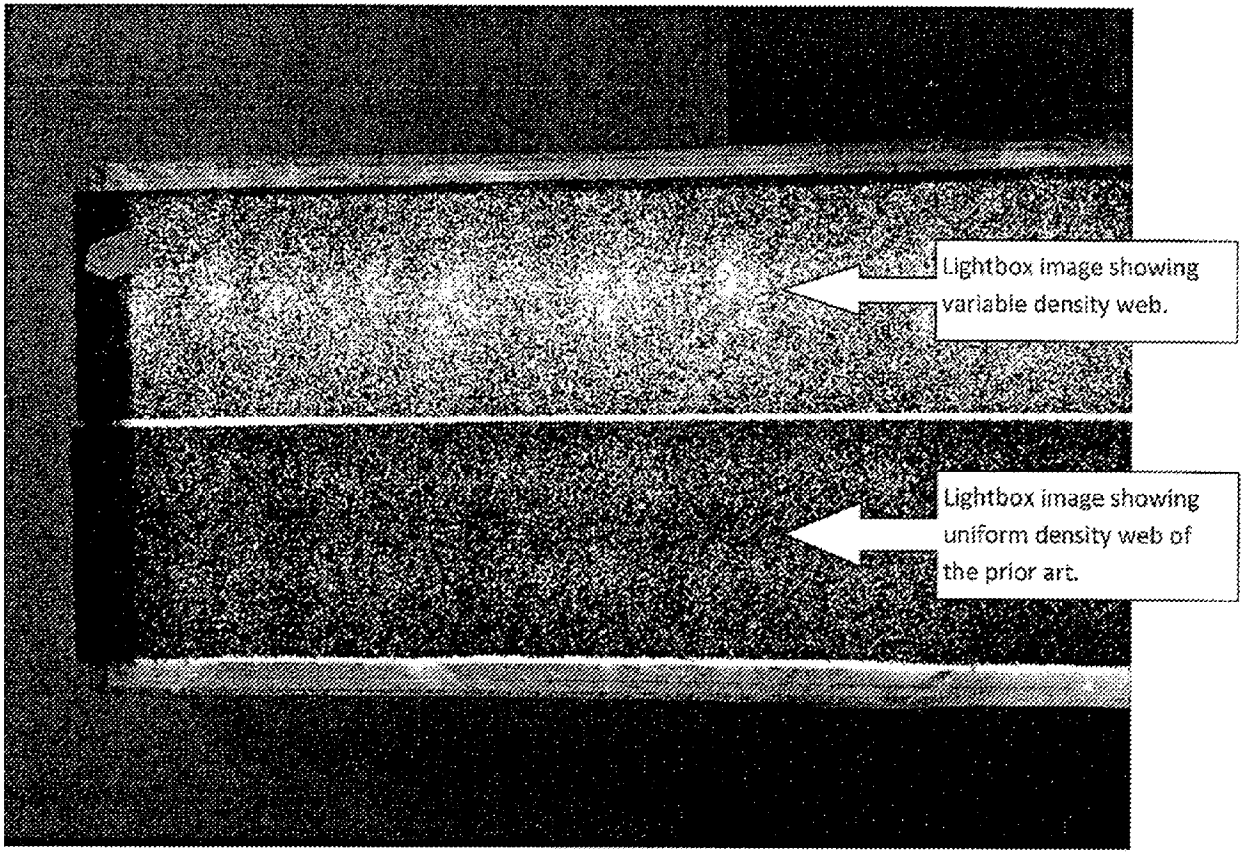
FIG. 6 is a top view of a light box showing high loft, non-woven, variable density web structure material of the present disclosure on top, and high loft, non-woven, uniform density web structure material of the prior art on bottom, wherein the densities of the two materials may be visually compared.

Turning now to FIG. 6, one may see and compare the structure of a high loft, non-woven, variable density web structure material produced according to the process of the present disclosure on top, and high loft, non-woven, uniform density web structure material produced according to the process of the prior art on bottom. In the sample shown in FIG. 6, one may observe three regions of varying density. In this Figure, regions of higher density are darker, whereas regions of lower density are lighter. It may readily be seen that higher density regions adjacent the two marginal edges run parallel to a central, lower density region.

Figure 7:
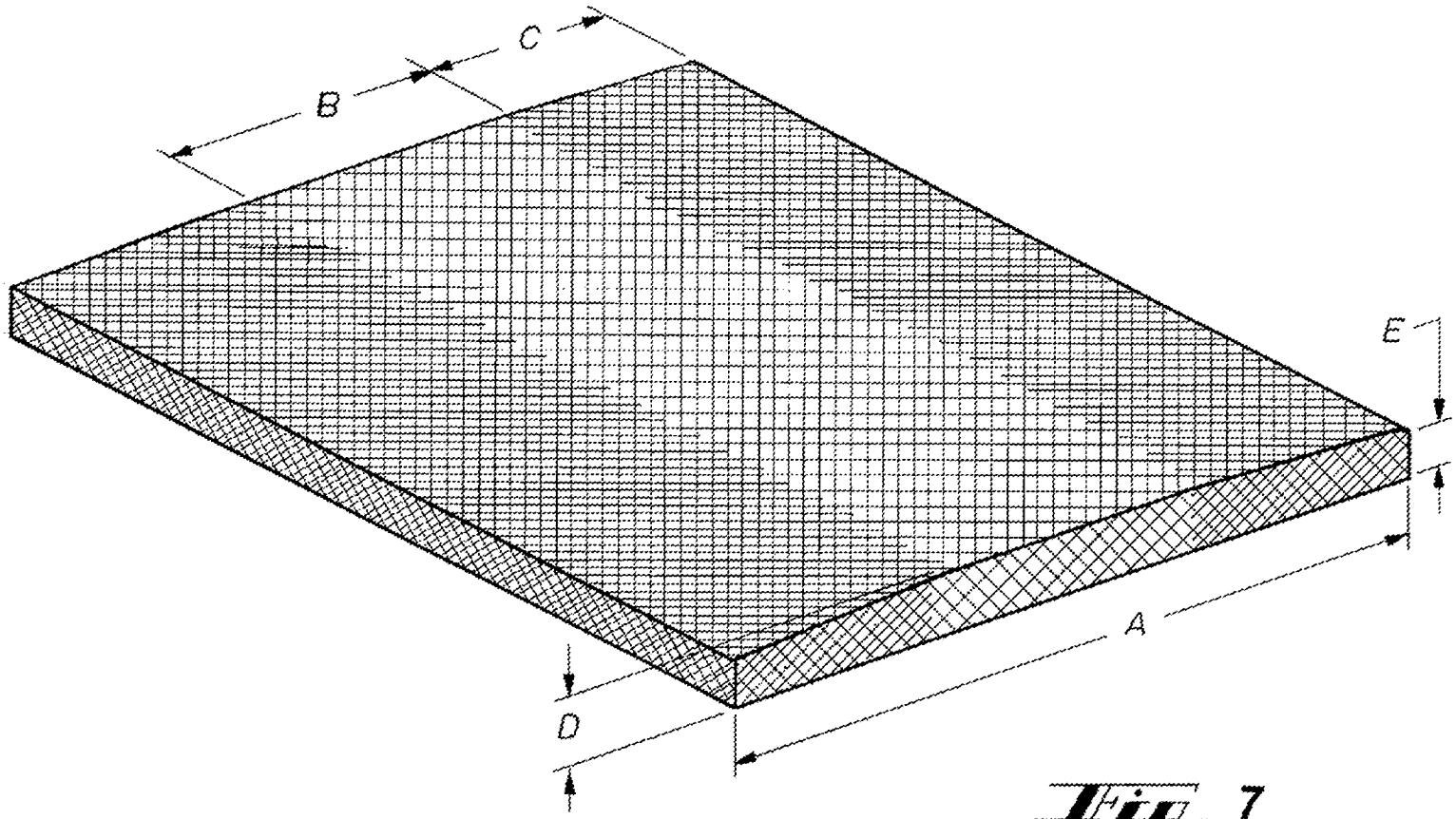
FIG. 7 is a perspective view of one embodiment of high loft, non-woven, variable density web structure material of the present disclosure, further depicting variable density and thickness properties of the material across a width thereof.

We next turn to FIG. 7, wherein an exemplary, varying density pattern will be depicted and described in greater detail. FIG. 7 shows a perspective view of one embodiment of high loft, non-woven, variable density web structure material produced in accordance with the present disclosure, wherein may be seen the variable density and thickness properties across a representative width thereof. In this Figure, a material having an overall (cut) width A of approximately 10.5 inches comprises three regions. In first and third regions C, each having a width of approximately 3.25 inches, the material thickness E is approximately 0.67 inches, corresponding to a density of approximately 31.7 ounces/square yard. In a second, central region B, having a width of approximately 4.00 inches, the material thickness D is approximately 0.77 inches, corresponding to a density of approximately 27.1 ounces/square yard.

Although FIG. 7 depicts one exemplary variable density web structure, it will be apparent to those of ordinary skill in the art that alternative, other, and further variable density web structures may be produced in accordance with the present disclosure, wherein higher and lower pressure regions are established across a condenser or other vacuum screen to correspond to any desired design specifications corresponding to the high loft, non-woven, variable density web structures to be produced. Of course, the same innovation can be applied to other types of machinery for producing such a web. Such machinery includes, for example, and without limitation, any static vacuum screen, rotating vacuum screen, or vacuum conveyor on which fibers are air laid.

Finally, we will turn to certain process variables which may have bearing, whether individually or in the aggregate, upon the characteristics of finished, high loft, non-woven, variable density web structures produced in accordance with the present disclosure.

Most obviously, the raw material or materials chosen for producing a particular variable density web structure will affect material performance and specifications. For example, polyester fiber generally has more resiliency than nylon or most natural fibers. As a result, polyester fiber can be used to produce a variable density, non-woven web with improved compression resistance properties.

Additionally, fiber type, denier, length, and crimp will affect material specifications and performance. It is noted that finer denier fibers are generally categorized between 1-40 denier, while course denier fibers are generally 45 denier and higher. As a point of reference, the fiber denier used to produce a variable density, non-woven web used for roof ridge ventilation is approximately 200 denier.

Fiber denier, which has a direct correlation to the fiber thickness, can greatly affect the overall density and stiffness of the manufactured, variable density, non-woven web. Given the same material weight, a non-woven web produced with finer denier fibers will be softer to the touch and denser than a web produced with course denier fibers. Since the course denier fibers have greater mass than fine denier fibers, a non-woven web produced at a given weight will contain a higher concentration of individual, finer denier fiber strands than the same web produced at the same weight using course denier fibers. Since there are a greater number of finer denier fibers per unit area than course denier fibers at the same weight, the web produced with finer denier fibers will restrict air flow to a greater degree than a web produced at the same weight using course denier fibers.

Similarly, the greater the denier, or diameter, of the fiber, the greater the spring, or resistance to compression, the material will exhibit. Accordingly, a non-woven web made with course denier fiber will have greater compression resistance than a non-woven web produced at the same weight using fine denier fibers.

Many synthetic staple fibers are produced at cut lengths of between 1-6 inches long and with multiple crimps per inch (cpi). The fiber length will affect primarily the tensile strength of the non-woven web, while the crimps will affect properties such as the tensile strength, the loft, and compression resistance of the web. When formed into a non-woven web, the fibers will become entangled. The web can, thereby, gain strength and compression resistance as the crimps in the fibers crossover each other.

Other process variables that can affect physical properties of the variable density, non-woven web include the rate at which the web forming feed roll rotates, which will control the amount of fiber entering into the web forming machine, which will, in turn, determine the overall average thickness of the non-woven web. Additionally, the velocity of the air stream in the web forming machine can affect web thickness and density.

Having thus described exemplary embodiments of the subject matter of the present disclosure, it is noted that the within disclosures are exemplary only and that various other alternatives, adaptations, and modifications may be made within the scope and spirit of the present innovative disclosure. Accordingly, the present subject matter is not limited to the specific embodiments as illustrated herein, but is only limited by the following claims.

We claim:

1. A process for creating a variable density, high loft, non-woven web structure, the process comprising the steps of:

(a.) establishing a non-uniform vacuum across the surface of a condenser screen in parallel banded regions to produce at least a first area having greater airflow than a second area; and (b.) condensing fiber onto said condenser screen in a non-uniform variable density arrangement across the surface of said condenser screen;

wherein fiber is directed more heavily to the first area of the condenser screen having greater airflow, and fiber is directed less heavily to the second area of the condenser screen having lesser airflow;

thereby, resulting in a high loft, non-woven web structure having density variations corresponding to the areas along the surface of said condenser screen having greater and lesser airflow.

2. The process of claim 1 wherein said condenser screen is a cylindrical condenser screen.

3. The process of claim 1 wherein said condenser screen is a vacuum screen.

4. The process of claim 1 wherein said condenser screen comprises at least one region having no holes.

5. The process of claim 1 wherein said condenser screen is selected from the group consisting of a static vacuum screen, a rotating vacuum screen, and a vacuum conveyor.

6. The process of claim 1 wherein regions of holes within said condenser screen are blocked, or otherwise obstructed, in spaced-apart, parallel arrangement across the surface of the condenser screen.

7. The process of claim 1 wherein said condenser screen comprises a plurality of regions having no holes.

8. The process of claim 1 wherein said condenser screen comprises at least one region having unbalanced or non-uniform hole patterns or hole distributions.

9. The process of claim 1 wherein said condenser screen comprises at least one region having smaller holes.

10. The process of claim 1 wherein said condenser screen comprises at least one region having a hole pattern or hole distribution varying from at least one other region of said condenser screen.

* * * * *